US009286913B2

(12) United States Patent
Nomura et al.

(10) Patent No.: US 9,286,913 B2
(45) Date of Patent: Mar. 15, 2016

(54) ATMOSPHERE EXPRESSION WORD SELECTION SYSTEM, ATMOSPHERE EXPRESSION WORD SELECTION METHOD, AND PROGRAM

(75) Inventors: Toshiyuki Nomura, Tokyo (JP); Yuzo Senda, Tokyo (JP); Kyota Higa, Tokyo (JP); Takayuki Arakawa, Tokyo (JP); Yasuyuki Mitsui, Tokyo (JP)

(73) Assignee: NEC CORPORATION, Tokyo (JP)

( * ) Notice: Subject to any disclaimer, the term of this patent is extended or adjusted under 35 U.S.C. 154(b) by 744 days.

(21) Appl. No.: 13/638,856

(22) PCT Filed: Mar. 28, 2011

(86) PCT No.: PCT/JP2011/057543

§ 371 (c)(1),
(2), (4) Date: Oct. 1, 2012

(87) PCT Pub. No.: WO2011/122522

PCT Pub. Date: Oct. 6, 2011

(65) Prior Publication Data

US 2013/0024192 A1 Jan. 24, 2013

(30) Foreign Application Priority Data

Mar. 30, 2010 (JP) ..... 2010-078123

(51) Int. Cl.

| | |
|---|---|
| ***G10H 7/00*** | (2006.01) |
| ***G10L 21/00*** | (2013.01) |
| ***G10L 25/63*** | (2013.01) |

(52) U.S. Cl.

CPC ..... *G10L 25/63* (2013.01); *G10H 2210/031* (2013.01); *G10H 2240/085* (2013.01); *G10H 2250/235* (2013.01)

(58) Field of Classification Search

CPC ..... G06F 17/30743; G06F 17/30038; G10L 25/57

See application file for complete search history.

(56) References Cited

U.S. PATENT DOCUMENTS 6,334,104 B1 * 12/2001 Hirai ..... 704/258
6,506,148 B2 * 1/2003 Loos ..... 600/27

(Continued)

FOREIGN PATENT DOCUMENTS

JP 2002-057736 A 2/2002
JP 06-268722 A 9/2004

(Continued)

OTHER PUBLICATIONS

Sundaram, Shiva, and Shrikanth Narayanan. "Classification of sound clips by two schemes: using onomatopoeia and semantic labels." Multimedia and Expo, 2008 IEEE International Conference on. IEEE, 2008.*

(Continued)

*Primary Examiner* — Matthew Baker

(74) *Attorney, Agent, or Firm* — Scully, Scott, Murphy & Presser, P.C.

(57) ABSTRACT

Disclosed is an information display system provided with: a signal analyzing unit which analyzes the audio signals obtained from a predetermined location and which generates ambient sound information regarding the sound generated at the predetermined location; and an ambient expression selection unit which selects an ambient expression which expresses the content of what a person is feeling from the sound generated at the predetermined location on the basis of the ambient sound information.

15 Claims, 7 Drawing Sheets

(56) References Cited

U.S. PATENT DOCUMENTS

| | | | | |
|---|---|---|---|---|
| 7,812,840 | B2 * | 10/2010 | Uranaka | G06T 13/20 345/419 |
| 8,183,997 | B1 * | 5/2012 | Wong et al. | 340/539.11 |
| 8,463,719 | B2 * | 6/2013 | Lyon | G10L 25/48 706/12 |
| 8,655,659 | B2 * | 2/2014 | Wang | G10L 13/033 704/231 |
| 2003/0037036 | A1 * | 2/2003 | Weare | 707/1 |
| 2004/0054519 | A1 * | 3/2004 | Kobayashi et al. | 704/1 |
| 2011/0190913 | A1 * | 8/2011 | Van De Sluis et al. | 700/94 |
| 2013/0182907 | A1 * | 7/2013 | Higa et al. | 382/103 |
| 2013/0188835 | A1 * | 7/2013 | Higa et al. | 382/103 |
| 2013/0279747 | A1 * | 10/2013 | Higa et al. | 382/103 |

FOREIGN PATENT DOCUMENTS

| | | | | |
|---|---|---|---|---|
| JP | 2006033562 | A | * | 2/2006 |
| JP | 2007-306597 | A | | 11/2007 |
| JP | 2008-204193 | A | | 9/2008 |
| JP | 2010-258687 | A | | 11/2010 |
| WO | WO 2008/032787 | A1 | | 3/2008 |
| WO | WO 2008/134625 | A1 | | 11/2008 |
| WO | WO 2009/090600 | A1 | | 7/2009 |

OTHER PUBLICATIONS

Ishihara, Kazushi, et al. "Automatic sound-imitation word recognition from environmental sounds focusing on ambiguity problem in determining phonemes." PRICAI 2004: Trends in Artificial Intelligence. Springer Berlin Heidelberg. 2004. 909-918.*

Ishihara, Kazushi et al., "Automatic Transformation of Environmental Sounds into Onomatopoeia Based on Japanese Syllable Structure," Technical Report of IEICE (2003), vol. 103, No. 154, pp. 19-24.

International Search Report dated Jul. 5, 2011 issued in PCT/JP2011/057543.

* cited by examiner

ATMOSPHERE EXPRESSION WORD SELECTION SYSTEM, ATMOSPHERE EXPRESSION WORD SELECTION METHOD, AND PROGRAM

TECHNICAL FIELD

The present invention relates to an atmosphere expression word selection system, an atmosphere expression word selection method, and a program therefor.

BACKGROUND ART

There is a case in which an atmosphere of a remote location should be conveyed to a user. In such a case, collecting surrounding sounds with a microphone etc. installed in the above field and causing the user to listen to the collected sound makes it possible to convey the surrounding atmosphere. However, there is a problem that the surrounding atmosphere of a talker cannot be completely conveyed because only a monaural sound can be collected with a microphone and an earphone.

Thereupon, the stereo telephone apparatus capable of realizing telephone communication having a high quality sound and a sense of presence has been proposed (for example, Patent literature 1).

In the stereo telephone apparatus described in the Patent literature 1, the stereo telephone machine users can stereophonically perform mutual communication with each other, whereby they can have a conversation with the voice that is more stereophonic than the monaural sound.

However, the surrounding environmental sound of the above field cannot be well conveyed to the user during a call between the stereo telephone machine users because the stereo telephone apparatus described in the Patent literature 1 conveys the surrounding environmental sound using a microphone for call.

Thereupon, the technology of Patent literature 2 has been proposed as a technology that aims for well conveying the environmental sound of the above field to the partner. In the technology of Patent literature 2, when a caller wants to convey the surrounding atmosphere or the like to a recipient during a call, the caller inputs the telephone number of a content server together with the telephone number of the recipient. As the content server, there exist the content server that collects the environmental sound around the caller and distributes it in real time as stereoscopic sound data, the content server that distributes music, and the like. Because the information of the content server specified in the transmission side is notified when a telephone machine originates a call, the reception side telephone apparatus acquires the stereoscopic sound data by making a connection to the content server based on this IP address information and reproduces the stereoscopic sound with a surround system connected to the telephone apparatus. This enables the recipient to feel almost the same atmosphere while having a call with the caller.

CITATION LIST

Patent Literature

PTL 1: JP-P1994-268722A

PTL 2: JP-P2007-306597A

SUMMARY OF INVENTION

Technical Problem

By the way, the human being, who lives in the various sounds including the voice, feels atmosphere for the sound itself other than the meaning/content of the voice. For example, now think about the field in which many human beings are present, the sound of people's moving around, the sound of people's opening documents, and the like are generated even though all human beings do not utter the voice. In such a case, for example, the human being feels that the above field is in a situation of "Gaya Gaya (onomatopoeia in Japanese)". On the other hand, there is also a case in which no sound is present at all or in a case in which the sound pressure level is almost next to silence. In such a case, the human being feels that the above field is in a situation of "shiin (mimetic word in Japanese)". In such a manner, the human being takes in various atmospheres from the sound (including the case of silence) that is felt in the above field.

However, the technologies of the Patent literature 1 and the Patent literature 2, which aim for causing the sound, which is being generated in the above field, to reappear as faithfully as possible and reproducing the sound field having a sense of presence, cannot convey the various atmospheres other than the sound the human being feels.

Thereupon, the present invention has been accomplished in consideration of the above-mentioned problems, and an object thereof is to provide an atmosphere expression word selection system that allows the atmosphere to be more easily shared mutually, and enables a sense of presence to be obtained by representing the atmosphere of the above field and the mutual situations with an atmosphere expression word that appeals to the human being's sensitivity, an atmosphere expression word selection method therefor and a program therefor.

Solution To Problem

The present invention for solving the above-mentioned problems is an atmosphere expression word selection system, comprising: a signal analyzing unit that analyzes audio signals and prepares atmospheric sound information related to a sound that is being generated in an acquisition location of said audio signals; and an atmosphere expression word selecting unit that selects an atmosphere expression word expressing what a person feels from the sound that is being generated in said acquisition location based on said atmospheric sound information.

The present invention for solving the above-mentioned problems is an atmosphere expression word selection method, comprising: analyzing audio signals, and preparing atmospheric sound information related to a sound that is being generated in an acquisition location of said audio signals; and selecting an atmosphere expression word expressing what a person feels from the sound that is being generated in said acquisition location based on said atmospheric sound information.

The present invention for solving the above-mentioned problems is a program for causing an information processing apparatus to execute: a signal analyzing process of analyzing audio signals and preparing atmospheric sound information related to a sound that is being generated in an acquisition location of said audio signals; and an atmosphere expression word selecting process of selecting an atmosphere expression word representing what a person feels from the sound that is being generated in said acquisition location based on said atmospheric sound information.

Advantageous Effect of Invention

The present invention allows the atmosphere to be more easily shared mutually and enables a sense of presence to be obtained by representing the atmosphere of the above field and the mutual situations with the atmosphere expression word that appeals to the human being's sensitivity.

DESCRIPTION OF EMBODIMENTS

The exemplary embodiments of the present invention will be explained.

At first, an outline of the present invention will be explained.

Figure 1:
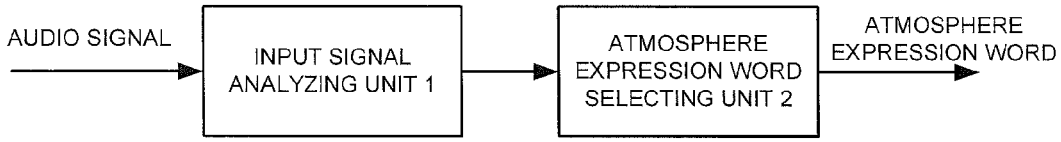
FIG. 1 is a block diagram of the atmosphere expression word selection system of this exemplary embodiment.

FIG. 1 is a block diagram of the atmosphere expression word selection system of this exemplary embodiment.

As shown in FIG. 1, the atmosphere expression word selection system of this exemplary embodiment includes an input signal analyzing unit 1 and an atmosphere expression word selecting unit 2.

The input signal analyzing unit 1 inputs audio signals acquired in a certain predetermined field, analyzes the audio signals, and prepares atmospheric sound information related to the sound that is being generated in the above predetermined field (hereinafter, described as an atmospheric sound). The so-called atmospheric sound is various sounds that are being generated in the field in which the audio signals have been acquired, for example, a voice and a concept including the environmental sound other than the voice. The human being, who lives in the various sounds including the voice, feels atmosphere for the sound itself other than the meaning/content of the voice. For example, now think about a field in which many human beings are present, the sound of people's moving around, the sound of people's opening documents, and the like are generated even though all human beings do not utter the voice. In such a case, the human being feels that the above field is, for example, in a situation of "Gaya Gaya". On the other hand, there is also a case in which no sound is generated at all even though many human beings are present, or a case in which the sound that is being generated is small (the audio signal sound pressure level is low). In such a case, the human being feels that the above field is in a situation of "ShiiN" In such a manner, the human being takes in various atmospheres from the sound (including the case of silence) that is felt in the above field.

Thereupon, the input signal analyzing unit 1 analyzes the audio signals of the atmospheric sound that is being generated in a predetermined field, analyzes which type of the atmospheric sound is being generated in the above field, and prepares the atmospheric sound information related to the atmospheric sound. Herein, the so-called atmospheric sound information is magnitude of the sound pressure of the audio signals, the frequency of the audio signals, the type of the audio signals (for example, a classification of the voice and the environmental sounds except the voice such as the sound of rain and the sound of an automobile) or the like.

The atmosphere expression word selecting unit 2 selects the atmosphere expression word corresponding to the atmospheric sound that is being generated in the field in which the audio signals have been acquired based on the atmospheric sound information prepared by the input signal analyzing unit 1. Herein, the so-called atmosphere expression word is a word expressing what the human being feels, for example, feeling, atmosphere and sense from the sound that is being generated in the field in which the audio signals have been acquired. As a representative word of the atmosphere expression word, there exist an onomatopoeic word and a mimetic word.

For example, when the atmospheric sound information is the sound pressure level of the audio signals, it is thinkable that the larger sound is being generated as the sound pressure level is higher, and it can be seen that the large sound is being generated in the field in which the audio signals have been acquired and the above field is noisy. Thereupon, the atmosphere expression word selecting unit 2 selects the atmosphere expression words "Zawa Zawa (onomatopoeia in Japanese)" and "Gaya Gaya", being the onomatopoeic word or the mimetic word, from which the atmosphere of the above field can be taken in. Further, when it is thinkable that the sound pressure level is almost next to zero, and near to silence, the atmosphere expression word selecting unit 2 selects the atmosphere expression word "ShiiN", being the onomatopoeic word or the mimetic word, from which the atmosphere of the above field can be taken in.

Further, when the atmospheric sound information is the frequency of the audio signals, it is thinkable that the frequency of the audio signals is changed according to a sound source of the sound. Thereupon, the atmosphere expression word selecting unit 2 selects "Ddo Ddo (onomatopoeia in Japanese)" that reminds of noise of constructions or "Boon (onomatopoeia in Japanese)" that reminds of an exhaust sound of an automobile when the frequency of the audio signals is low, and selects the atmosphere expression word representing a metallic imagination such as "Kan Kan (onomatopoeia in Japanese)" or the atmosphere expression word of hitting trees such as "Kon Kon (onomatopoeia in Japanese)" when, on the contrary, the frequency of the audio signals is high.

In addition, when the classification of the audio signals is employed as the atmospheric sound information, the atmosphere expression word selecting unit 2 selects the more accurate atmosphere expression word according to the classification of the sound that is being generated in the above field. For example, the atmosphere expression word selecting unit 2 can select "Ddo Ddo" or "Boon" by distinguishing the sound of a drill used in the construction from the exhaust sound of the automobile.

The atmosphere expression words selected in such a manner are outputted according to a format that is used for text data, meta data such as Exif, and tags for retrieving moving pictures, the outputting of the atmosphere expression words by the sound, and the like.

This, as compared with the conventional technology that, so far, pays attention to reappearance of the faithful sound field in order to obtain a sense of presence, namely, the atmosphere of the above field and the mutual situations, allows the atmosphere to be more easily shared mutually by more clearly expressing the atmosphere of the above field and mutual situations with the atmosphere expression word appealing to the human being's sensitivity, thereby making it possible to obtain a sense of presence.

Hereinafter, specific exemplary embodiments will be explained.

<First Exemplary Embodiment>

The first exemplary embodiment will be explained.

The first exemplary embodiment prepares the atmospheric sound information by paying attention to magnitude of the sound of the audio signals acquired from the atmospheric sound that is being generated at a certain predetermined field. And, an example of selecting the atmosphere expression word (the onomatopoeic word and the mimetic word) suitable for the field in which the audio signals have been acquired based on the atmospheric sound information will be explained.

Figure 2:
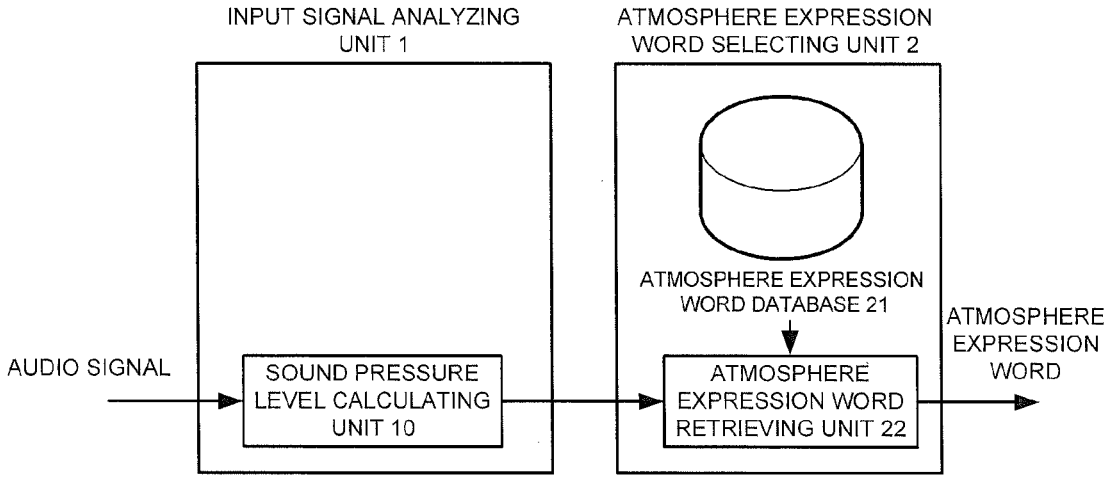
FIG. 2 is a block diagram of the atmosphere expression word selection system of a first exemplary embodiment.

FIG. 2 is a block diagram of the atmosphere expression word selection system of the first exemplary embodiment.

The atmosphere expression word selection system of the first exemplary embodiment includes an input signal analyzing unit 1 and an atmosphere expression word selecting unit 2.

The input signal analyzing unit 1 includes a sound pressure level calculating unit 10. The sound pressure level calculating unit 10 calculates the sound pressure of the audio signals of the inputted atmospheric sound, and outputs a value (0 to 1.0) obtained by normalizing the sound pressure level as the atmospheric sound information to the atmosphere expression word selecting unit 2.

The atmosphere expression word selecting unit 2 includes an atmosphere expression word database 21 and an atmosphere expression word retrieving unit 22.

The atmosphere expression word database 21 is a database having the atmosphere expression words corresponding to the value (0 to 1.0) of the atmospheric sound information stored therein. One example of the atmosphere expression word database 21 is shown in FIG. 3.

Figure 3:
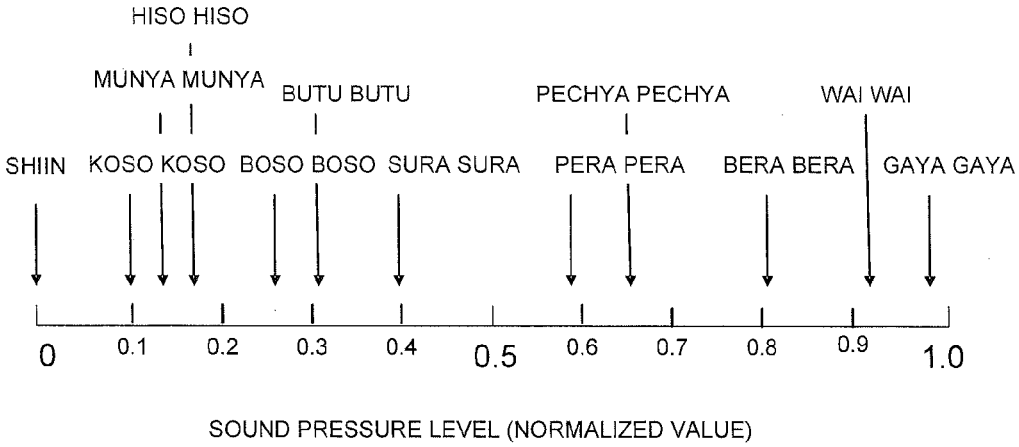
FIG. 3 is a view illustrating one example of an atmosphere expression word database 21.

The atmosphere expression word database 21 shown in FIG. 3 shows the values of the atmospheric sound information (the sound pressure level: 0 to 1.0) and the atmosphere expression words (for example, the onomatopoeic words and the mimetic words) corresponding hereto, and for example, the atmosphere expression word in a case in which the value of the atmospheric sound information is "0.0" is "Shiin" and the atmosphere expression word in a case in which the value of the atmospheric sound information is "0.1" is "Koso Koso (onomatopoeia in Japanese)". Further, the atmosphere expression word in a case in which the value of the atmospheric sound information is "0.9 or more and less than 0.95" is "Wai Wai (onomatopoeia in Japanese)", and the atmosphere expression word in a case in which the value of the atmospheric sound information is "0.95 or more and 1 or less" is "Gaya Gaya". In such a manner, the atmosphere expression words corresponding to the values of the atmospheric sound information are stored.

The atmosphere expression word retrieving unit 22 inputs the atmospheric sound information from the input signal analyzing unit 1, and retrieves the atmospheric expression word corresponding to this atmospheric sound information from the atmosphere expression word database 21. For example, when the value of the atmospheric sound information obtained from the input signal analyzing unit 1 is "0.64", the atmosphere expression word retrieving unit 22 selects the atmosphere expression word corresponding to "0.64" from the atmosphere expression word database 21. In an example of the atmosphere expression word database 21 shown in FIG. 3, the atmosphere expression word corresponding to "0.64" is "Pechya Pechya (onomatopoeia in Japanese)" existing between 0.6 and 0.7. Thus, the atmosphere expression word retrieving unit 22 retrieves "Pechya Pechya" as the atmosphere expression word corresponding to the value of the atmospheric sound information "0.64". The retrieved atmosphere expression words are outputted according to a format that is used for text data, meta data such as Exif, and tags for retrieving moving pictures, the outputting of the atmosphere expression words by the sound, and the like.

As mentioned above, the first exemplary embodiment makes it possible to obtain the atmosphere expression word (the onomatopoeic word and the mimetic word) expressing the atmosphere and the mutual situations corresponding to magnitude of the sound of the above field, which appeals to the human being's sensitivity because the atmosphere expression word (the onomatopoeic word and the mimetic word) corresponding to magnitude of the sound of the above field is selected.

<Second Exemplary Embodiment>

The second exemplary embodiment will be explained.

The second exemplary embodiment is configured to frequency-analyze the audio signals acquired from the atmospheric sound that is being generated in a certain predetermined field, and to prepare the atmospheric sound information by paying attention to magnitude of the sound and a frequency spectrum, besides the configuration of the first exemplary embodiment. And, an example of selecting the atmosphere expression word suitable for the field in which the audio signals have been acquired based on the atmospheric sound information will be explained.

Figure 4:
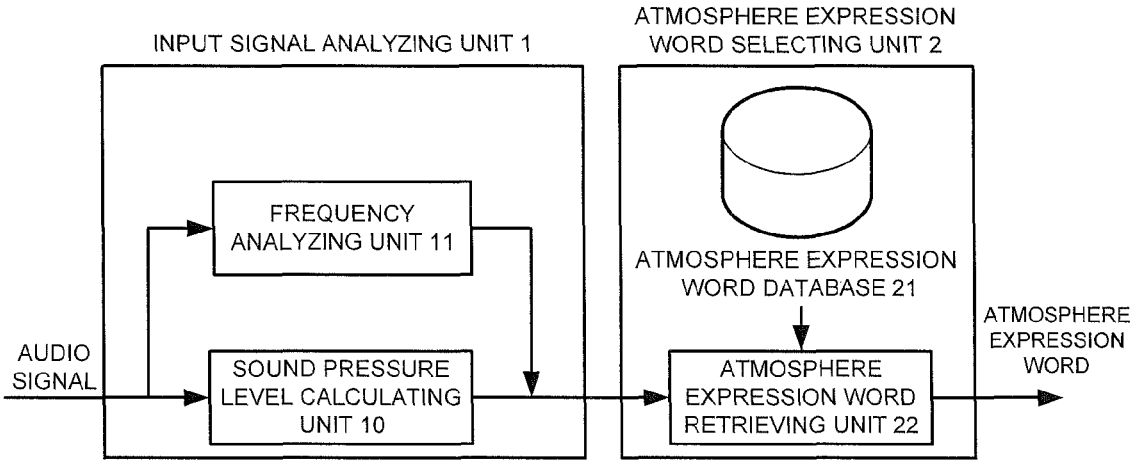
FIG. 4 is a block diagram of the atmosphere expression word selection system of a second exemplary embodiment.

FIG. 4 is a block diagram of the atmosphere expression word selection system of the second exemplary embodiment.

The input signal analyzing unit 1 includes a frequency analyzing unit 11 besides the components of the first exemplary embodiment.

The frequency analyzing unit 11 calculates frequency information representing features over the frequency of the sound such as a fundamental frequency of the input signals, a center of gravity of the frequency, a frequency band, a gradient of a spectrum envelop, and a number of harmonic tones.

Figure 5:
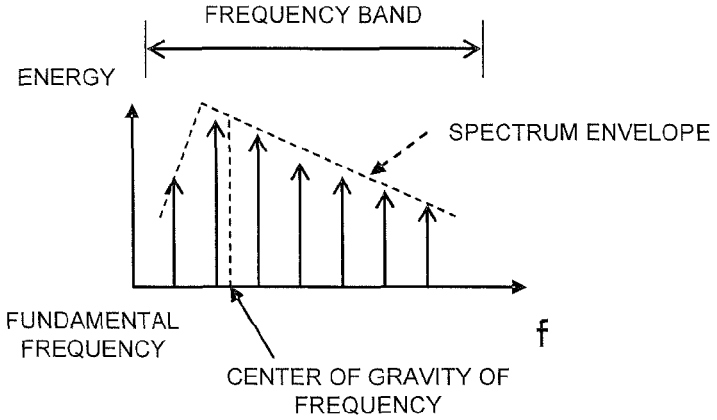
FIG. 5 is a view for explaining an example of frequency information of audio signals.

A conceptual view of each item is shown in FIG. 5.

Herein, the so-called fundamental frequency, which is a frequency representing a pitch of the periodical sound, is governed by an oscillation period of the sound, and the pitch of the sound is high when the oscillation period of the sound is short and the pitch of the sound is low when the oscillation period of the sound is long. Further, the so-called center of gravity of the frequency, which is a weighted average of the frequency with an energy defined as a weight, represents the pitch of the sound with noise. Further, the so-called frequency band is an attainable band of the frequency of the inputted audio signals. Further, the so-called spectrum envelope represents a rough tendency of the spectrum, and its gradient exerts an influence upon a tone.

The frequency analyzing unit 11 outputs the frequency information as mentioned above as the atmospheric sound information.

The atmosphere expression word retrieving unit 22 inputs the sound pressure level and the frequency information as the atmospheric sound information, and selects the atmosphere expression word corresponding to the atmospheric sound information from the atmosphere expression word database 21. For this reason, not only the sound pressure level but also the atmosphere expression word corresponding to the atmospheric sound information that has been learned in consideration of the frequency information as well is stored in the atmosphere expression word database 21. Further, the atmosphere expression word retrieving unit 22 inputs the sound pressure level and the frequency information as the atmospheric sound information, and selects the atmosphere expression word suitable for the sound pressure level and the frequency information from the atmosphere expression word database 21.

One example of retrieving the atmosphere expression word by the atmosphere expression word retrieving unit 22 will be explained.

Figure 6:
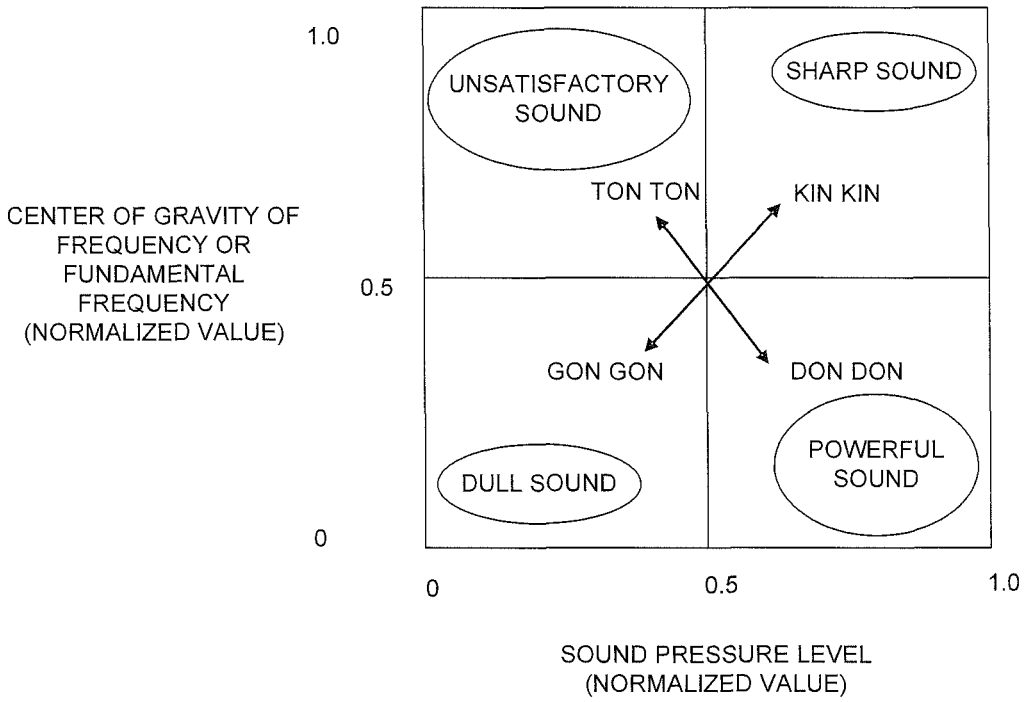
FIG. 6 is a view illustrating one example of the atmosphere expression word database 21 having the atmosphere expression words mapped hereto in two dimensions of a sound pressure level (normalized value) and a center of gravity of a frequency (normalized value) in a case in which atmospheric sound information is the sound pressure level and the center of gravity of the frequency (normalized value).

FIG. 6 is a view illustrating one example of the atmosphere expression word database 21 having the atmosphere expression words mapped hereto in two dimensions of the sound pressure level (noinialized value) and the center of gravity of the frequency (normalized value) in a case in which the atmospheric sound information is the sound pressure level and the center of gravity of the frequency (normalized value).

The atmosphere expression word retrieving unit 22, upon receipt of, for example, the atmospheric sound information of which the value of the sound pressure level and the value of the center of gravity of the frequency are large and small, respectively, judges that a powerful sound is being generated in the field in which the audio signals have been acquired, and selects the atmosphere expression word "Don Don (onomatopoeia in Japanese)". On the other hand, the atmosphere expression word retrieving unit 22, upon receipt of the atmospheric sound information of which the value of the sound pressure level and the value of the center of gravity of the frequency are small and large, respectively, judges that an unsatisfactory sound is being generated in the field in which the audio signals have been acquired, and selects the atmosphere expression word "Ton Ton (onomatopoeia in Japanese)". Further, the atmosphere expression word retrieving unit 22, upon receipt of the atmospheric sound information of which not only the value of the sound pressure level and but also the value of the center of gravity of the frequency is large, judges that a sharp sound is being generated in the field in which the audio signals have been acquired, and selects the atmosphere expression word "Kin Kin (onomatopoeia in Japanese)". On the other hand, the atmosphere expression word retrieving unit 22, upon receipt of the atmospheric sound information of which not only the value of the sound pressure level and but also the value of the center of gravity of the frequency is small, judges that a dull sound is being generated in the field in which the audio signals have been acquired, and selects the atmosphere expression word "Gon Gon (onomatopoeia in Japanese)". Additionally, the situation is similar with the fundamental frequency instead of the center of gravity of the frequency.

Figure 7:
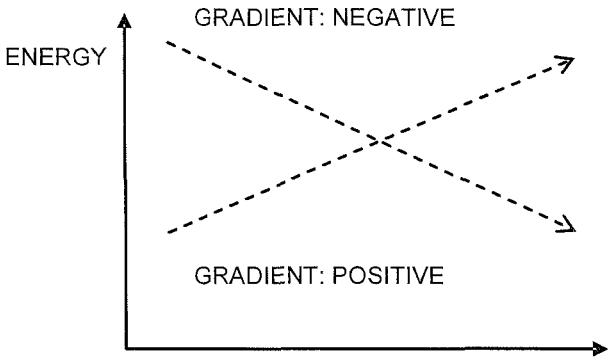
FIG. 7 is a view for explaining an example in which the frequency information is a gradient of a spectrum envelop.

While an example of selecting the atmosphere expression word in terms of the sound pressure level, and the center of gravity of the frequency or the fundamental frequency was shown in the above description, the selection of the atmosphere expression word is not limited hereto. For example, as shown in FIG. 7, the atmosphere expression word retrieving unit 22 may select the atmosphere expression word corresponding to the sound pressure level from among the atmosphere expression words with a voiced sound as the atmosphere expression word having a dull impression when the frequency information is a gradient of the spectrum envelope and its gradient is negative, and may select the atmosphere expression word corresponding to the sound pressure level from among the atmosphere expression words with no voiced sound as the atmosphere expression word having a sharp impression when the gradient is positive.

Figure 8:
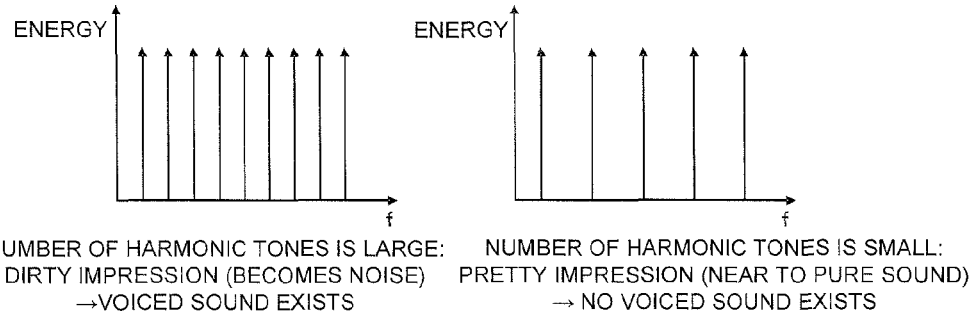
FIG. 8 is a view for explaining an example in which the frequency information is a number of harmonic tones.

Further, for example, as shown in FIG. 8, the atmosphere expression word retrieving unit 22 may select the atmosphere expression word corresponding to the sound pressure level from among the atmosphere expression words with a voiced sound, which gives a dirty impression (becomes noise), when the frequency information is the number of harmonic tones and its number is large, and may select the atmosphere expression word corresponding to the sound pressure level from among the atmosphere expression words with no voiced sound, which gives a pretty impression (near to a pure sound), when its number is small.

Figure 9:
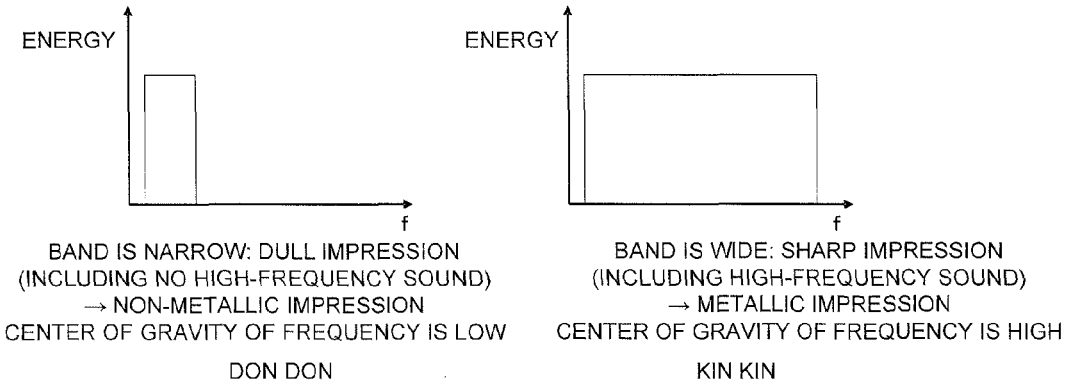
FIG. 9 is a view for explaining an example in which the frequency information is a frequency band and the center of gravity of the frequency.

In addition, for example, as shown in FIG. 9, the atmosphere expression word retrieving unit 22 select the atmosphere expression word corresponding to the sound pressure level, for example "Don Don", from among the atmosphere expression words such that a non-metallic impression, being a dull impression, (including no high frequency sound) is given and yet the low pitched sound is expressed when the frequency information is the frequency band and the center of gravity of the frequency, its band is narrow and the center of gravity of the frequency is low. On the other hand, the atmosphere expression word retrieving unit 22 may select the atmosphere expression word corresponding to the sound pressure level, for example "Kin Kin", from among the atmosphere expression words such that a metallic impression, being a sharp impression, (including the high frequency sound) is given and yet the high pitched sound is expressed when its band is wide and the center of gravity of the frequency is high.

The atmosphere expression words selected in such a manner are outputted according to a format that is used for text data, meta data such as Exif, and tags for retrieving moving pictures, the outputting of the atmosphere expression words by the sound, and the like.

Additionally, a plurality of the items of the frequency information explained above may be employed.

Further, while an example of combining the sound pressure level and the frequency information was explained in the above-mentioned example, it is also possible to select the atmosphere expression word employing only the frequency information.

As mentioned above, in the second exemplary embodiment, adding the frequency information to the atmospheric sound information besides the sound pressure level makes it possible to select the atmosphere expression word representing the atmosphere of the above field all the more.

<Third Exemplary Embodiment>

The third exemplary embodiment will be explained.

The third exemplary embodiment is configured to discriminate the voice from the environmental sound other than the voice in terms of the audio signals acquired from the atmospheric sound that is being generated in a certain predetermined field and to prepare the atmospheric sound information by paying attention to magnitude of the sound, the frequency analysis, and the discrimination of the voice from the environmental sound, besides the configuration of the second exemplary embodiment. And, the third exemplary embodiment selects the atmosphere expression word suitable for the field in which the audio signals have been acquired based on the atmospheric sound information.

Figure 10:
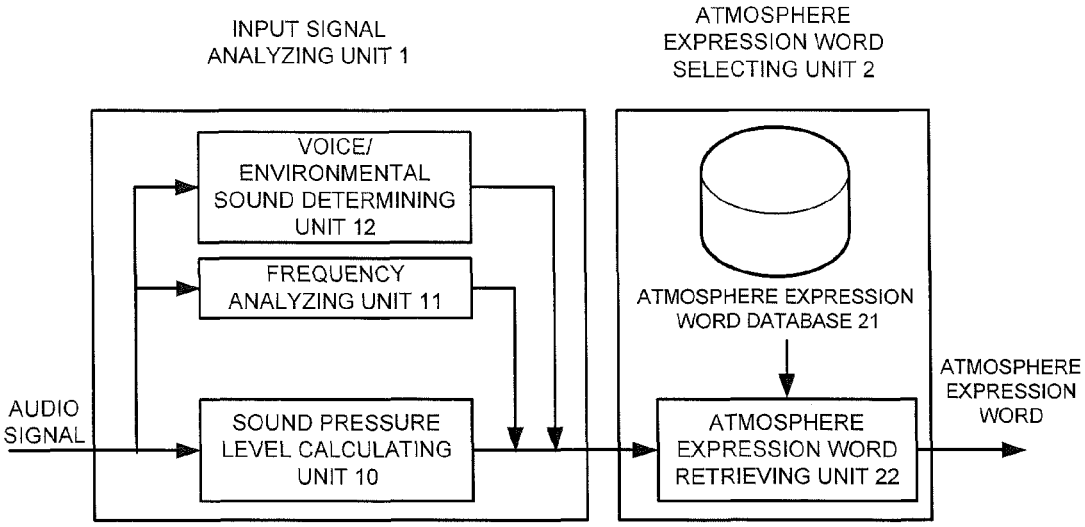
FIG. 10 is a block diagram of the atmosphere expression word selection system of a third exemplary embodiment.

FIG. 10 is a block diagram of the atmosphere expression word selection system of the third exemplary embodiment.

The input signal analyzing unit 1 includes a voice/environmental sound determining unit 12 besides the components of the second exemplary embodiment.

The voice/environmental sound determining unit 12 determines whether the inputted audio signals are the voice that a person has uttered or the other environmental sound. The following methods are thinkable as a determination method.

(1) The voice/environmental sound determining unit 12 determines that the audio signals are the environmental sound except the voice when a temporal change in a spectrum shape of the audio signals is too small (stationary noise) or too rapid (sudden noise).

(2) The voice/environmental sound determining unit 12 determines that the audio signals are the environmental sound except the voice when the spectrum shape of the audio signals is flat or near to 1/f.

(3) The voice/environmental sound determining unit 12 performs a linear prediction of several milliseconds or so (the tenth order for 8 kHz sampling) for the audio signals, and determines that the audio signals are the voice when its linear prediction gain is large, and the audio signals are the environmental sound when its linear prediction gain is small. Further, the voice/environmental sound determining unit 12 performs a long-time prediction of ten and several milliseconds or so (the 40th to 160th order for 8 kHz sampling) for the audio signals, and determines that the audio signals are the voice when its long-time prediction gain is large, and the audio signals are the environmental sound when its long-time prediction gain is small.

(4) The voice/environmental sound determining unit 12 converts the input sound of the audio signals into a cepstrum, measures a distance between the converted signal and a standard model of the voice, and determines that the audio signals are the environmental sound except the voice when the above input sound is distant by a constant distance or more.

(5) The voice/environmental sound determining unit 12 converts the input sound of the audio signals into a cepstrum, measures a distance between the converted signal and a standard model of the voice and a distance between the converted signal and a garbage model or a universal model, and determines that the above input sound is the environmental sound except the voice when the converted signal is near to the garbage model or the universal model.

As a standard model of the voice of the above-described model, Gaussian Mixture Model (GMM), Hidden Markov Model (HMM), and the like may be employed. The GMM and the HMM are prepared in advance statically from the voice that a person has uttered, or are prepared by employing an algorithm for machine learning. Additionally, the so-called garbage model is a model prepared from the sound other than utterance of a person, and the so-called universal model is a model prepared by all putting together the voice that a person has uttered and the sound other than it.

The input signal analyzing unit 1 outputs the sound pressure level calculated by the sound pressure level calculating unit 10, the frequency information calculated by the frequency analyzing unit 11, the classification of the sound (the voice, or the environmental sound other than the voice) calculated by the voice/environmental sound determining unit 12 as the atmospheric sound information.

The atmosphere expression word retrieving unit 22 of the third exemplary embodiment, which is similar to that of the second embodiment in a basic configuration, inputs the sound pressure level, the frequency information, and the classification of the sound (the voice, or the environmental sound other than the voice) as the atmospheric sound information, and retrieves the atmosphere expression word. For this reason, not only the sound pressure level and the frequency information but also the atmosphere expression words corresponding to the atmospheric sound information that has been learned in consideration of the classification as well of the voice or the environmental sound other than the voice are stored in the atmosphere expression word database 21.

The atmosphere expression word retrieving unit 22 retrieves the atmosphere expression word "Hiso Hiso (onomatopoeia in Japanese)" corresponding to the voice, for example, when the sound that is being generated in the field in which the audio signals have been acquired is the voice, the fundamental frequency is high, and the sound pressure level is low. On the other hand, the atmosphere expression word retrieving unit 22 retrieves the atmosphere expression word "Gaya Gaya" corresponding to the voice when the sound that is being generated in the field in which the audio signals have been acquired is the voice, the fundamental frequency is low, and the sound pressure level is high. Further, the atmosphere expression word retrieving unit 22 retrieves the atmosphere expression word corresponding to the environmental sound other than the voice, for example, the atmosphere expression word "Gon Gon" when the sound that is being generated in the field in which the audio signals have been acquired is the environmental sound other than the voice, the center of gravity of the frequency is low, and the sound pressure level is low. On the other hand, the atmosphere expression word retrieving unit 22 retrieves the atmosphere expression word corresponding to the environmental sound other than the voice, for example, the atmosphere expression word "Kin Kin" when the sound that is being generated in the field in which the audio signals have been acquired is the environmental sound other than the voice, the center of gravity of the frequency is high, and the sound pressure level is high. And, the retrieved atmosphere expression words are outputted according to a format that is used for text data, meta data such as Exif, and tags for retrieving moving pictures.

Additionally, when the sound is determined to be the voice by the voice/environmental sound determining unit 12, the atmosphere expression word retrieving unit 22 may analyze the number of talkers based on the sound pressure level and the frequency information, and may select the atmosphere expression word suitable for its number of the talkers. For example, the atmosphere expression word retrieving unit 22 retrieves "Butu Butu (onomatopoeia in Japanese)" when one parson talks in a small voice, "Waa (onomatopoeia in Japanese)" when one parson talks in a large voice, "Hiso Hiso" when a plurality of parsons talk in a small voice, and "Wai Wai" when a plurality of parsons talk in a large voice.

The atmosphere expression words selected in such a manner are outputted according to a format that is used for text data, meta data such as Exif, and tags for retrieving moving pictures, the outputting of the atmosphere expression words by the sound, and the like.

Additionally, while an example of combining the sound pressure level, the frequency information, and the discrimination of the voice from the environmental sound was explained in the above-mentioned example, it is also possible to select the atmosphere expression word by employing only the discrimination of the voice from the environmental sound, and by employing a combination of the sound pressure level and the discrimination of the voice from the environmental sound.

The third exemplary embodiment makes it possible to select the atmosphere expression word corresponding to the classification of the sound that is being generated in the field in which the audio signals have been acquired because the voice is discriminated from the environmental sound other than the voice.

<Fourth Exemplary Embodiment>

The fourth exemplary embodiment will be explained.

The fourth exemplary embodiment is further configured to discriminate the classification of the environmental sound other than the voice, and to prepare the atmospheric sound information by paying attention to magnitude of the sound, the frequency analysis, and the discrimination of the atmospheric sound (the classification of the voice and the environmental sound such as the sound of the automobile), besides the configuration of the third exemplary embodiment. And, an example of selecting the atmosphere expression word suitable for the field in which the audio signals have been acquired based on the atmospheric sound information will be explained.

Figure 11:
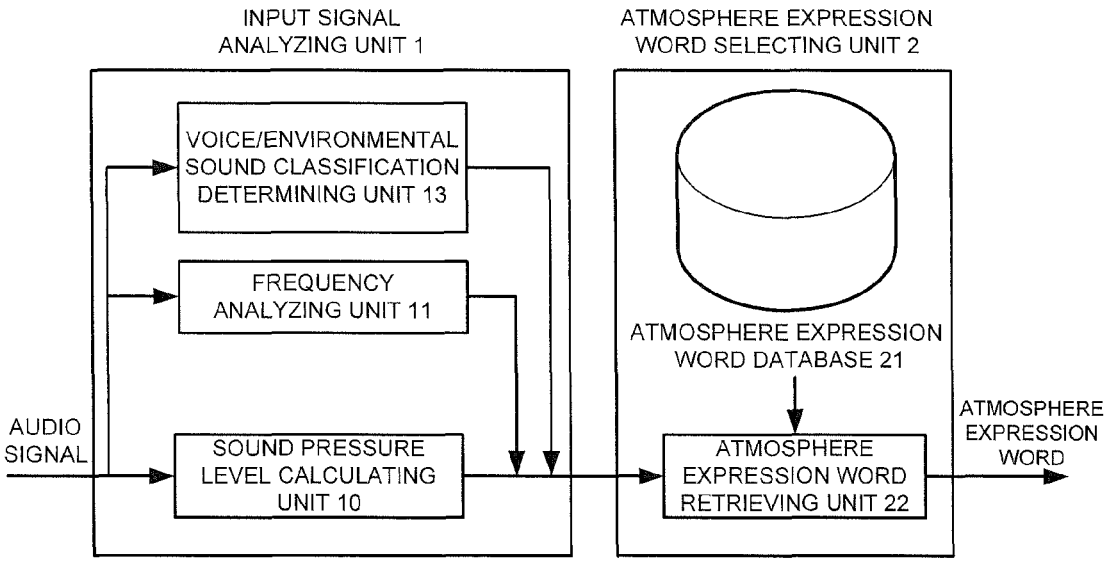
FIG. 11 is a block diagram of the atmosphere expression word selection system of a fourth exemplary embodiment.

FIG. 11 is a block diagram of the atmosphere expression word selection system of the fourth exemplary embodiment.

The input signal analyzing unit 1 includes a voice/environmental sound classification determining unit 13 besides the components of the second exemplary embodiments.

The voice/environmental sound classification determining unit 13 determines the voice that a person has uttered, and the classification of the environmental sound other than the voice for the inputted audio signals. The method of using the GMM and the method of using the HMM are thinkable as a determination method. For example, the GMM and the HMM previously prepared for each type of the environmental sound other than the voice are stored, and the classification of the environmental sound of which a distance to the input sound is nearest is selected. The technology described in Literature "Spoken Language Processing 29-14, Environmental Sound Discrimination Based on Hidden Markov Model" may be referenced for the method of discriminating the classification of these environmental sounds.

The input signal analyzing unit 1 outputs the sound pressure level calculated by the sound pressure level calculating unit 10, the frequency information calculated by the frequency analyzing unit 11, the classification of the environmental sound (the classification of the environmental sounds such as the voice, the sound of the automobile, the sound of rain) calculated by the voice/environmental sound classification determining unit 13 as the atmospheric sound information.

The atmosphere expression word retrieving unit 22 inputs the sound pressure level, the frequency information, and the classification of the environmental sound (the classification of the environmental sounds such as the voice, the sound of the automobile, the sound of rain) as the atmospheric sound information, and selects the atmosphere expression word. For this reason, not only the sound pressure level and the frequency information but also the atmosphere expression word corresponding to the atmospheric sound information that has been learned in consideration of the classification as well of the voice or the environmental sound other than the voice are stored in the atmosphere expression word database 21.

For example, the atmosphere expression word retrieving unit 22 retrieves the atmosphere expression word "Kan Kan" corresponding to "the sound of striking metal" when the classification of the sound that is being generated in the field in which the audio signals have been acquired is "the sound of striking metal", the center of gravity of the frequency is high, and the sound pressure level is low. On the other hand, the atmosphere expression word retrieving unit 22 retrieves the atmosphere expression word "Gan Gan" corresponding to "the sound of striking metal" when the classification of the sound that is being generated in the field in which the audio signals have been acquired is "the sound of striking metal", the center of gravity of the frequency is low, and the sound pressure level is low. And, the retrieved atmosphere expression words are outputted according to a format that is used for text data, meta data such as Exif, and tags for retrieving moving pictures, the outputting of the atmosphere expression words by the sound, and the like.

Additionally, while an example of combining the sound pressure level, the frequency information, and the discrimination of the atmospheric sound was explained in the above-mentioned example, it is also possible to select the atmosphere expression word by employing only the discrimination of the atmospheric sound, and by employing a combination of the sound pressure level and the discrimination of the atmospheric sound.

The fourth exemplary embodiment makes it possible to select the atmosphere expression word corresponding to the classification of the sound that is being generated in the field in which the audio signals have been acquired because the classification of the environmental sound is discriminated in addition to the above-described embodiments.

<Fifth Exemplary Embodiment>

The fifth exemplary embodiment will be explained.

In the fifth exemplary embodiment, an example of taking action for selecting the atmosphere expression word only when the audio signals are in a certain constant level will be explained.

Figure 12:
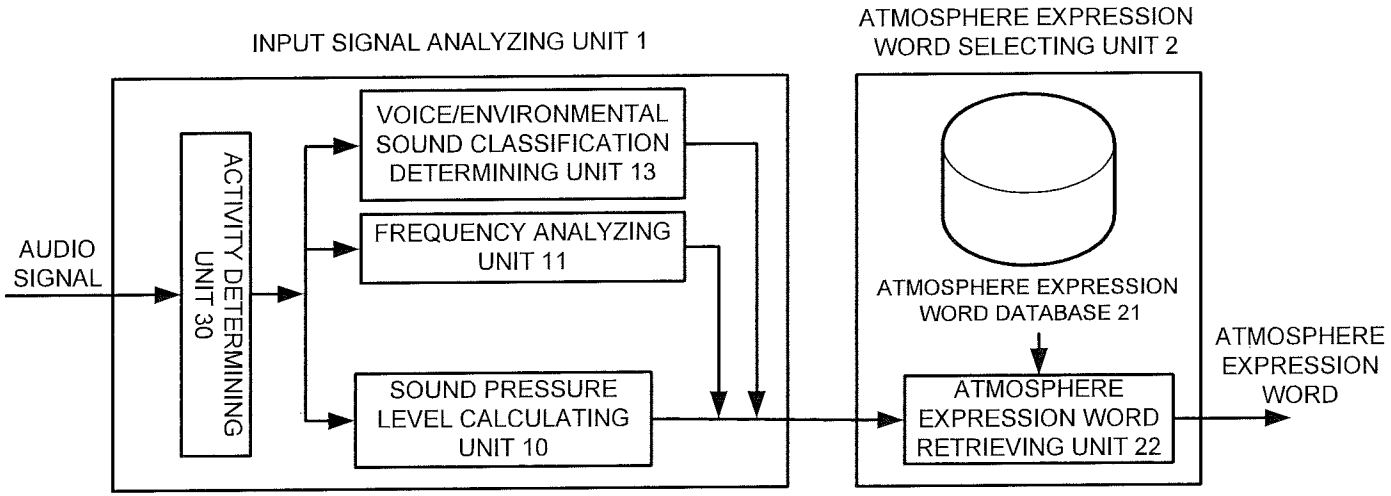
FIG. 12 is a block diagram of the atmosphere expression word selection system of a fifth exemplary embodiment.

FIG. 12 is a block diagram of the atmosphere expression word selection system of the fifth exemplary embodiment.

The input signal analyzing unit 1 includes an activity determining unit 30 besides the components of the fourth exemplary embodiments.

The activity determining unit 30 outputs the audio signals to the sound pressure level calculating unit 10, the frequency analyzing unit 11, and the voice/environmental sound classification determining unit 13 only when the audio signals are in a certain constant level.

The fifth exemplary embodiment makes it possible to prevent the wasteful process of selecting the atmosphere expression word, and the like because the action for selecting the atmosphere expression word is taken only when the audio signals are in a certain constant level.

<Sixth Exemplary Embodiment>

The sixth exemplary embodiment will be explained.

In the sixth exemplary embodiment, an example of performing the above-described exemplary embodiments by a computer that operates under a program will be explained.

Figure 13:
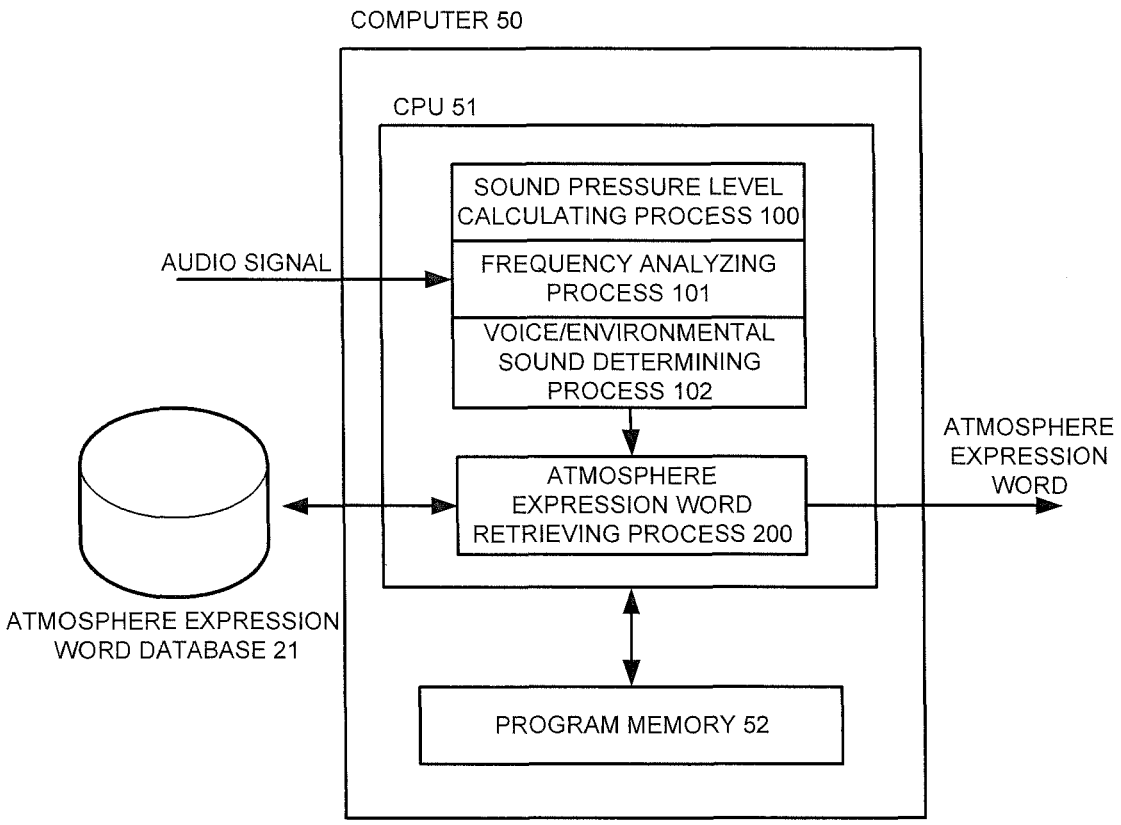
FIG. 13 is a block diagram of the atmosphere expression word selection system of a sixth exemplary embodiment.

FIG. 13 is a block diagram of the atmosphere expression word selection system of the sixth exemplary embodiment.

The atmosphere expression word selection system of the sixth exemplary embodiment includes a computer 50 and an atmosphere expression word database 21.

The computer 50 includes a program memory 52 having the program stored therein, and a CPU 51 that operates under the program.

The CPU 51 performs the process similar to the operation of the sound pressure level calculating unit 10 in a sound pressure level calculating process 100, the process similar to the operation of the frequency analyzing unit 11 in a frequency analyzing process 101, the process similar to the operation of the voice/environmental sound determining unit 12 in a voice/environmental sound determining process 102, and the process similar to the operation of the atmosphere expression word retrieving unit 22 in an atmosphere expression word retrieving process 200.

Additionally, the atmosphere expression word database 21 may be stored inside the computer 50.

Further, while the action under the program equivalent to the process of the third exemplary embodiment was exemplified in this exemplary embodiment, the action under the program is not limited hereto, and the action under the program equivalent to the processes of the first, the second, the fourth and the fifth exemplary embodiments may be realized with the computer.

Further, the content of the above-mentioned exemplary embodiments can be expressed as follows.

(Supplementary note 1) An atmosphere expression word selection system, comprising:

a signal analyzing unit that analyzes audio signals and prepares atmospheric sound information related to a sound that is being generated in an acquisition location of said audio signals; and an atmosphere expression word selecting unit that selects an atmosphere expression word expressing what a person feels from the sound that is being generated in said acquisition location based on said atmospheric sound information.

(Supplementary note 2) The atmosphere expression word selection system according to Supplementary note 1, wherein said atmosphere expression word is at least one of an onomatopoeic word and a mimetic word.

(Supplementary note 3) The atmosphere expression word selection system according to Supplementary note 1 or Supplementary note 2, wherein said signal analyzing unit analyzes at least one of a sound pressure level of the audio signals, frequency information representing features of a frequency of the audio signals, and a classification of the sound of the audio signals, and prepares the atmospheric sound information.

(Supplementary note 4) The atmosphere expression word selection system according to Supplementary note 3, wherein in a case in which said atmospheric sound information includes the sound pressure level, said atmosphere expression word selecting unit selects the atmosphere expression word expressing noisiness all the more as said sound pressure level becomes larger.

(Supplementary note 5) The atmosphere expression word selection system according to Supplementary note 3 or Supplementary note 4, wherein in a case in which said atmospheric sound information includes a fundamental frequency or a center of gravity of a frequency, said atmosphere expression word selecting unit selects:

the atmosphere expression word expressing a low-pitched sound when said fundamental frequency or said center of gravity of the frequency is low; and the atmosphere expression word expressing a high-pitched sound when said fundamental frequency or said center of gravity of the frequency is high.

(Supplementary note 6) The atmosphere expression word selection system according to one of Supplementary note 3 to Supplementary note 5, wherein in a case in which said atmospheric sound information includes a frequency band, and the fundamental frequency or the center of gravity of the frequency, said atmosphere expression word selecting unit selects:

the atmosphere expression word that gives a non-metallic impression including no high frequency sound and yet expresses the low-pitched sound when said frequency band is narrow, and said fundamental frequency or said center of gravity of the frequency is low; and the atmosphere expression word that gives a metallic impression including a high frequency sound and yet expresses the high-pitched sound when said frequency band is wide, and said fundamental frequency or said center of gravity of the frequency is high.

(Supplementary note 7) The atmosphere expression word selection system according to one of Supplementary note 3 to Supplementary note 6, wherein in a case in which said atmospheric sound information includes a gradient of a spectrum envelop, said atmosphere expression word selecting unit selects:

the atmosphere expression word with a voiced sound as the atmosphere expression word having a dull impression when said gradient of the spectrum envelop is negative; and the atmosphere expression word with no voiced sound as the atmosphere expression word having a sharp impression when said gradient of the spectrum envelop is positive.

(Supplementary note 8) The atmosphere expression word selection system according to one of Supplementary note 3 to Supplementary note 7, wherein in a case in which said atmospheric sound information includes the sound pressure level, and the center of gravity of the frequency or the fundamental frequency, said atmosphere expression word selecting unit selects:

the atmosphere expression word expressing a more forceful sound as said sound pressure level becomes higher and yet said center of gravity of the frequency or said fundamental frequency becomes lower;

the atmosphere expression word expressing a more unsatisfactory sound as said sound pressure level becomes lower and yet said center of gravity of the frequency or said fundamental frequency becomes higher;

the atmosphere expression word expressing a duller sound as said sound pressure level becomes lower and yet said center of gravity of the frequency or said fundamental frequency becomes lower; and the atmosphere expression word expressing a sharper sound as said sound pressure level becomes higher and yet said center of gravity of the frequency or said fundamental frequency becomes higher.

(Supplementary note 9) The atmosphere expression word selection system according to one of Supplementary note 3 to Supplementary note 8, wherein in a case in which said atmospheric sound information includes the classification of the sound, said atmosphere expression word selecting unit selects the atmosphere expression word suitable for the classification of the sound.

(Supplementary note 10) An atmosphere expression word selection method, comprising:

analyzing audio signals, and preparing atmospheric sound information related to a sound that is being generated in an acquisition location of said audio signals; and selecting an atmosphere expression word expressing what a person feels from the sound that is being generated in said acquisition location based on said atmospheric sound information.

(Supplementary note 11) The atmosphere expression word selection method according to Supplementary note 10, wherein said atmosphere expression word is at least one of an onomatopoeic word and a mimetic word.

(Supplementary note 12) The atmosphere expression word selection method according to Supplementary note 10 or Supplementary note 11, comprising analyzing at least one of a sound pressure level of the audio signals, frequency information representing features of a frequency of the audio signals, and a classification of the sound of the audio signals, and preparing the atmospheric sound information.

(Supplementary note 13) The atmosphere expression word selection method according to Supplementary note 12, comprising selecting, in a case in which said atmospheric sound information includes the sound pressure level, the atmosphere expression word expressing noisiness all the more as said sound pressure level becomes higher.

(Supplementary note 14) The atmosphere expression word selection method according to Supplementary note 12 or Supplementary note 13, comprising selecting, in a case in which said atmospheric sound information includes a fundamental frequency or a center of gravity of a frequency:

the atmosphere expression word expressing a low-pitched sound when said fundamental frequency or said center of gravity of the frequency is low; and the atmosphere expression word expressing a high-pitched sound when said fundamental frequency or said center of gravity of the frequency is high.

(Supplementary note 15) The atmosphere expression word selection method according to one of Supplementary note 12 to Supplementary note 14, comprising selecting, in a case in which said atmospheric sound information includes a frequency band, and the fundamental frequency or the center of gravity of the frequency:

the atmosphere expression word that gives a non-metallic impression including no high frequency sound and yet expresses the low-pitched sound when said frequency band is narrow, and said fundamental frequency or said center of gravity of the frequency is low; and the atmosphere expression word that gives a metallic impression including a high frequency sound and yet expresses the high-pitched sound when said frequency band is wide, and said fundamental frequency or said center of gravity of the frequency is high.

(Supplementary note 16) The atmosphere expression word selection method according to one of Supplementary note 12 to Supplementary note 15, comprising selecting, in a case in which said atmospheric sound information includes a gradient of a spectrum envelop:

the atmosphere expression word with a voiced sound as the atmosphere expression word having a dull impression when said gradient of the spectrum envelop is negative; and the atmosphere expression word with no voiced sound as the atmosphere expression word having a sharp impression when said gradient of the spectrum envelop is positive.

(Supplementary note 17) The atmosphere expression word selection method according to one of Supplementary note 12 to Supplementary note 16, comprising selecting, in a case in which said atmospheric sound information includes the sound pressure level, and the center of gravity of the frequency or the fundamental frequency:

the atmosphere expression word expressing a more forceful sound as said sound pressure level becomes higher and yet said center of gravity of the frequency or said fundamental frequency becomes lower;

the atmosphere expression word expressing a more unsatisfactory sound as said sound pressure level becomes lower and yet said center of gravity of the frequency or said fundamental frequency becomes higher;

the atmosphere expression word expressing a duller sound as said sound pressure level becomes lower and yet said center of gravity of the frequency or said fundamental frequency becomes lower; and the atmosphere expression word expressing a sharper sound as said sound pressure level becomes higher and yet said center of gravity of the frequency or said fundamental frequency becomes higher.

(Supplementary note 18) The atmosphere expression word selection method according to one of Supplementary note 12 to Supplementary note 17, comprising selecting, in a case in which said atmospheric sound information includes the classification of the sound, the atmosphere expression word suitable for said classification of the sound.

(Supplementary note 19) A program for causing an information processing apparatus to execute:

a signal analyzing process of analyzing audio signals and preparing atmospheric sound information related to a sound that is being generated in an acquisition location of said audio signals; and an atmosphere expression word selecting process of selecting an atmosphere expression word representing what a person feels from the sound that is being generated in said acquisition location based on said atmospheric sound information.

Above, although the present invention has been particularly described with reference to the preferred embodiments, it should be readily apparent to those of ordinary skill in the art that the present invention is not always limited to the above-mentioned embodiments, and changes and modifications in the form and details may be made without departing from the spirit and scope of the invention.

This application is based upon and claims the benefit of priority from Japanese patent application No. 2010-078123, filed on Mar. 30, 2010, the disclosure of which is incorporated herein in its entirety by reference.

REFERENCE SIGNS LIST

1 input signal analyzing unit
2 atmosphere expression word selecting unit
3 sound pressure level calculating unit
11 frequency analyzing unit
12 voice/environmental sound determining unit
13 voice/environmental sound classification determining unit
21 atmosphere expression word database
22 atmosphere expression word retrieving unit
30 activity determining unit
50 computer
51 CPU
52 program memory

The invention claimed is:

1. An atmosphere expression word selection system, comprising:

a signal analyzing unit that analyzes audio signals and prepares atmospheric sound information related to a sound that is being generated in an acquisition location of said audio signals; and an atmosphere expression word selecting unit that selects an atmosphere expression word expressing what a person feels from the sound that is being generated in said acquisition location based on said atmospheric sound information, wherein said signal analyzing unit analyzes at least one of a sound pressure level of the audio signals, frequency information representing features of a frequency of the audio signals, and a classification of the sound of the audio signals, and prepares the atmospheric sound information, and wherein in a case in which said atmospheric sound information includes the sound pressure level, said atmosphere expression word selecting unit selects the atmosphere expression word expressing a louder noise as said sound pressure level becomes larger.

2. The atmosphere expression word selection system according to claim 1, wherein said atmosphere expression word is at least one of an onomatopoeic word and a mimetic word.

3. The atmosphere expression word selection system according to claim 1, wherein in a case in which said atmospheric sound information includes a fundamental frequency or a center of gravity of a frequency, said atmosphere expression word selecting unit selects:

the atmosphere expression word expressing a low-pitched sound when said fundamental frequency or said center of gravity of the frequency is low; and the atmosphere expression word expressing a high-pitched sound when said fundamental frequency or said center of gravity of the frequency is high.

4. The atmosphere expression word selection system according to claim 1, wherein in a case in which said atmospheric sound information includes a frequency band, and the fundamental frequency or the center of gravity of the frequency, said atmosphere expression word selecting unit selects:

the atmosphere expression word that gives a non-metallic impression including no high frequency sound and yet expresses the low-pitched sound when said frequency band is narrow, and said fundamental frequency or said center of gravity of the frequency is low; and the atmosphere expression word that gives a metallic impression including a high frequency sound and yet expresses the high-pitched sound when said frequency band is wide, and said fundamental frequency or said center of gravity of the frequency is high.

5. The atmosphere expression word selection system according to claim 1, wherein in a case in which said atmospheric sound information includes a gradient of a spectrum envelope, said atmosphere expression word selecting unit selects:

the atmosphere expression word with a voiced sound as the atmosphere expression word having a dull impression when said gradient of the spectrum envelope is negative; and the atmosphere expression word with no voiced sound as the atmosphere expression word having a sharp impression when said gradient of the spectrum envelope is positive.

6. The atmosphere expression word selection system according to claim 1, wherein in a case in which said atmospheric sound information includes the sound pressure level, and the center of gravity of the frequency or the fundamental frequency, said atmosphere expression word selecting unit selects:

the atmosphere expression word expressing a more forceful sound as said sound pressure level becomes higher and yet said center of gravity of the frequency or said fundamental frequency becomes lower;

the atmosphere expression word expressing a more unsatisfactory sound as said sound pressure level becomes lower and yet said center of gravity of the frequency or said fundamental frequency becomes higher;

the atmosphere expression word expressing a duller sound as said sound pressure level becomes lower and yet said center of gravity of the frequency or said fundamental frequency becomes lower; and the atmosphere expression word expressing a sharper sound as said sound pressure level becomes higher and yet said center of gravity of the frequency or said fundamental frequency becomes higher.

7. The atmosphere expression word selection system according to claim 1, wherein in a case in which said atmospheric sound information includes the classification of the sound, said atmosphere expression word selecting unit selects the atmosphere expression word suitable for the classification of the sound.

8. An atmosphere expression word selection method, comprising:

analyzing audio signals, and preparing atmospheric sound information related to a sound that is being generated in an acquisition location of said audio signals; and analyzing at least one of a sound pressure level of the audio signals, frequency information representing features of a frequency of the audio signals, and a classification of the sound of the audio signals; and selecting an atmosphere expression word expressing what a person feels from the sound that is being generated in said acquisition location based on the analyzing at least one of a sound pressure level of the audio signals, frequency information representing features of a frequency of the audio signals, and a classification of the sound of the audio signals, wherein in a case in which said atmospheric sound information includes the sound pressure level, the atmosphere expression word expressing a louder noise as said sound pressure level becomes higher.

9. The atmosphere expression word selection method according to claim 8, wherein said atmosphere expression word is at least one of an onomatopoeic word and a mimetic word.

10. The atmosphere expression word selection method according to claim 8, comprising selecting, in a case in which said atmospheric sound information includes a fundamental frequency or a center of gravity of a frequency:

the atmosphere expression word expressing a low-pitched sound when said fundamental frequency or said center of gravity of the frequency is low; and the atmosphere expression word expressing a high-pitched sound when said fundamental frequency or said center of gravity of the frequency is high.

11. The atmosphere expression word selection method according to claim 8, comprising selecting, in a case in which said atmospheric sound information includes a frequency band, and the fundamental frequency or the center of gravity of the frequency:

the atmosphere expression word that gives a non-metallic impression including no high frequency sound and yet expresses the low-pitched sound when said frequency band is narrow, and said fundamental frequency or said center of gravity of the frequency is low; and the atmosphere expression word that gives a metallic impression including a high frequency sound and yet expresses the high-pitched sound when said frequency band is wide, and said fundamental frequency or said center of gravity of the frequency is high.

12. The atmosphere expression word selection method according to claim 8, comprising selecting, in a case in which said atmospheric sound information includes a gradient of a spectrum envelope:

the atmosphere expression word with a voiced sound as the atmosphere expression word having a dull impression when said gradient of the spectrum envelope is negative; and the atmosphere expression word with no voiced sound as the atmosphere expression word having a sharp impression when said gradient of the spectrum envelope is positive.

13. The atmosphere expression word selection method according to claim 8, comprising selecting, in a case in which said atmospheric sound information includes the sound pressure level, and the center of gravity of the frequency or the fundamental frequency:

the atmosphere expression word expressing a more forceful sound as said sound pressure level becomes higher and yet said center of gravity of the frequency or said fundamental frequency becomes lower;

the atmosphere expression word expressing a more unsatisfactory sound as said sound pressure level becomes lower and yet said center of gravity of the frequency or said fundamental frequency becomes higher;

the atmosphere expression word expressing a duller sound as said sound pressure level becomes lower and yet said center of gravity of the frequency or said fundamental frequency becomes lower; and the atmosphere expression word expressing a sharper sound as said sound pressure level becomes higher and yet said center of gravity of the frequency or said fundamental frequency becomes higher.

14. The atmosphere expression word selection method according to claim 8, comprising selecting, in a case in which said atmospheric sound information includes the classification of the sound, the atmosphere expression word suitable for said classification of the sound.

15. A non-transitory computer readable storage medium storing a program for causing an information processing apparatus to execute:

analyzing audio signals and preparing atmospheric sound information related to a sound that is being generated in an acquisition location of said audio signals; and analyzing at least one of a sound pressure level of the audio signals, frequency information representing features of a frequency of the audio signals, and a classification of the sound of the audio signal;

selecting an atmosphere expression word representing what a person feels from the sound that is being generated in said acquisition location based on said analyzing at least one of a sound pressure level of the audio signals, frequency information representing features of a frequency of the audio signals, and a classification of the sound of the audio signals, wherein in a case in which said atmospheric sound information includes the sound pressure level, the atmosphere expression word expressing a louder noise as said sound pressure level becomes higher.

* * * * *